US006419527B2

(12) United States Patent
Reichle

(10) Patent No.: US 6,419,527 B2
(45) Date of Patent: Jul. 16, 2002

(54) ADAPTER AND PLUG FOR COMMUNICATIONS AND CONTROL ENGINEERING

(75) Inventor: Hans Reichle, Wetzikon (CH)

(73) Assignee: Reichle & De-Massari AG, Wetzikon (CH)

( * ) Notice: Subject to any disclaimer, the term of this patent is extended or adjusted under 35 U.S.C. 154(b) by 0 days.

(21) Appl. No.: 09/789,761

(22) Filed: Feb. 22, 2001

(30) Foreign Application Priority Data

Feb. 24, 2000 (CH) ..... 0363/00

(51) Int. Cl.[7] ..... H01R 24/00

(52) U.S. Cl. ..... 439/676; 439/344; 439/680; 439/540.1

(58) Field of Search ..... 439/676, 638, 439/418, 344, 941, 680, 540.1

(56) References Cited

U.S. PATENT DOCUMENTS 5,328,390 A * 7/1994 Johnston et al. ..... 439/638

* cited by examiner

*Primary Examiner*—Tho D. Ta
*Assistant Examiner*—Ann McCamey
(74) *Attorney, Agent, or Firm*—Nath & Associates PLLC; Gary M. Nath; Marvin C. Berkowitz

(57) ABSTRACT

An adapter for a standardised socket, in particular for a RJ45 or RJ11 socket, comprising a housing with an opening as well as guide means bounding an opening, wherein the opening is configured such that one or more plug(s) arranged side by side can be introduced, and wherein the guide means are configured and oriented such that each plug which is introduced has electrically conductive contact with socket contacts of the socket.

15 Claims, 7 Drawing Sheets

ADAPTER AND PLUG FOR COMMUNICATIONS AND CONTROL ENGINEERING

BACKGROUND OF THE INVENTION

The invention relates to an adapter, in particular for RJ45 sockets. The invention also relates to a plug for an adapter of this kind.

An RJ45 plug connector is a standard which is standardised according to EN 60603-7 IEC 60603-7 and worldwide for plug connectors in communications and data networks. Plug connectors of this kind are used, for example, for building cabling, together with, inter alia, shielded cables with four signal conductor pairs. The sockets for RJ45 plug connectors of this kind have a standardised contact arrangement and opening geometry. The plugs each comprise 8 plug contacts which are arranged in parallel with one another and which, when inserted, establish an electrical connection with socket contacts arranged in a correspondingly adapted manner.

The disadvantage of this known plug connector lies in the fact that all electrical contacts are always simultaneously contacted. If different services have to be transmitted via the four signal conductor pairs, for example a computer network on two signal conductor pairs and, e.g. a telephone and a fax machine on the remaining two signal conductor pairs, three individual RJ45 sockets with a respective 8-pole plug are required to connect them.

This is very expensive and also requires a correspondingly large space.

SUMMARY OF THE INVENTION

An object of the invention is to form a plug connection part, in particular for RJ45 plug connectors, which, with one socket, offers a high number of connection possibilities and permits better utilisation of the copper cable, therefore being less expensive.

The object is solved in particular by an adapter for a standardised socket, in particular for a RJ45 or RJ11 socket, comprising a housing with an opening as well as guide means bounding this, wherein the opening is configured such that at least two plugs arranged side by side can be introduced, and wherein the guide means are configured and oriented such that each plug which is introduced has an electrically conductive connection by way of its contacts with contacts of the socket.

The adapter is arranged in front of the opening in the socket and serves to guide a plurality of individual plugs and hold them in the opening in the socket such that the contacts of the introduced plugs establish electrical contact with the contacts of the socket. The plug contacts must be configured such that they are adapted to the geometry of the adapter. The plugs thus configured preferably have two, four or eight poles.

The adapter therefore has the advantage of enabling two, three or four individual plugs to be introduced into an existing socket, in particular into a RJ45 socket. This permits a far more flexible use of the sockets of existing building cabling systems, without having to instal additional RJ45 sockets. The adapter also permits a high level of flexibility when rewiring with a small number of installed RJ45 sockets.

The adapter as well as the plugs configured in adaptation to this adapter thus enable inexpensive and flexible building cabling to be achieved.

In addition to the 8-pole embodiment disclosed in the following, the adapter according to the invention may also be formed with a different number of poles, for example in a 6-pole construction according to the RJ11 standard.

BRIEF DESCRIPTION OF THE DRAWINGS

For a better understanding of the invention and to show how the same may be carried into effect, reference will now be made, by way of example, to the accompanying drawings, in which.

DESCRIPTION OF THE PREFERRED EMBODIMENTS

Figure 1:
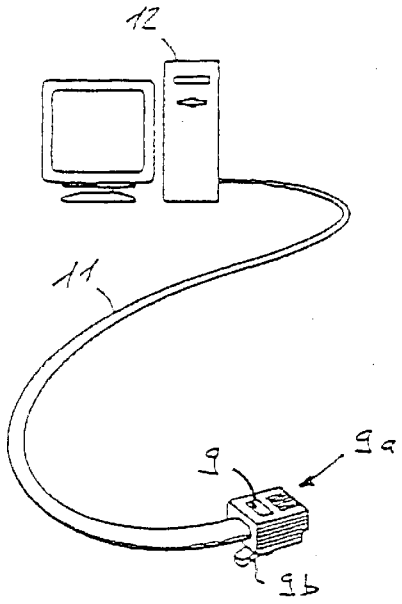
Fig. 1 (Prior Art)
FIG. 1 shows a RJ45 plug connector.

FIG. 1 shows a computer 12, which is connected via a cable 11 to a communications network, also called a LAN. The cable 11 comprises four paired, twisted electrical conductors, also called a "twisted pair", and is suitable, for example, for computer networks with a high bandwidth, for video or telephone lines. An 8-pole RJ45 plug 9 is arranged at the end of the cable 11, this plug comprising at its top side eight plug contacts 9*a* which extend parallel to one another and are at a standardised spacing of, in particular, 1.016 mm (0.04 inches) from one another. The plug 8 also comprises a latch means 9*b*, by means of which the plug 9 can be secured in the socket 10 in a removable manner.

Figure 2A:
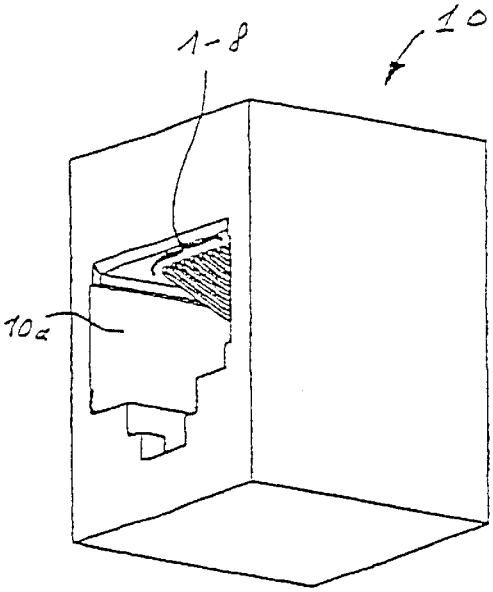
Fig. 2a (Prior Art)
FIG. 2*a* is a perspective view of a RJ45 socket.
Figure 2B:
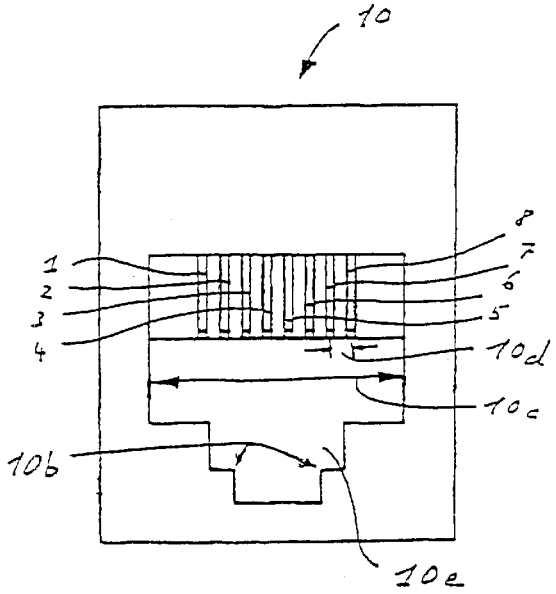
Fig. 2b (Prior Art)
FIG. 2*b* is a front view of a RJ45 socket.

The socket 10 with the interior space 10*a* and the socket contacts 1–8, which extend in the upper region of the interior space 10*a*, is represented in FIG. 2*a*. The front view of the socket 10 according to FIG. 2*b* shows the standardised geometry of the opening 10*e* with inside width 10*c* and lock-in elements 10*b*. The arrangement of the socket contacts 1–8 is also standardised, their mutual spacing also being 0.04 inches in correspondence with the plug contacts 9*a*.

Figure 3:
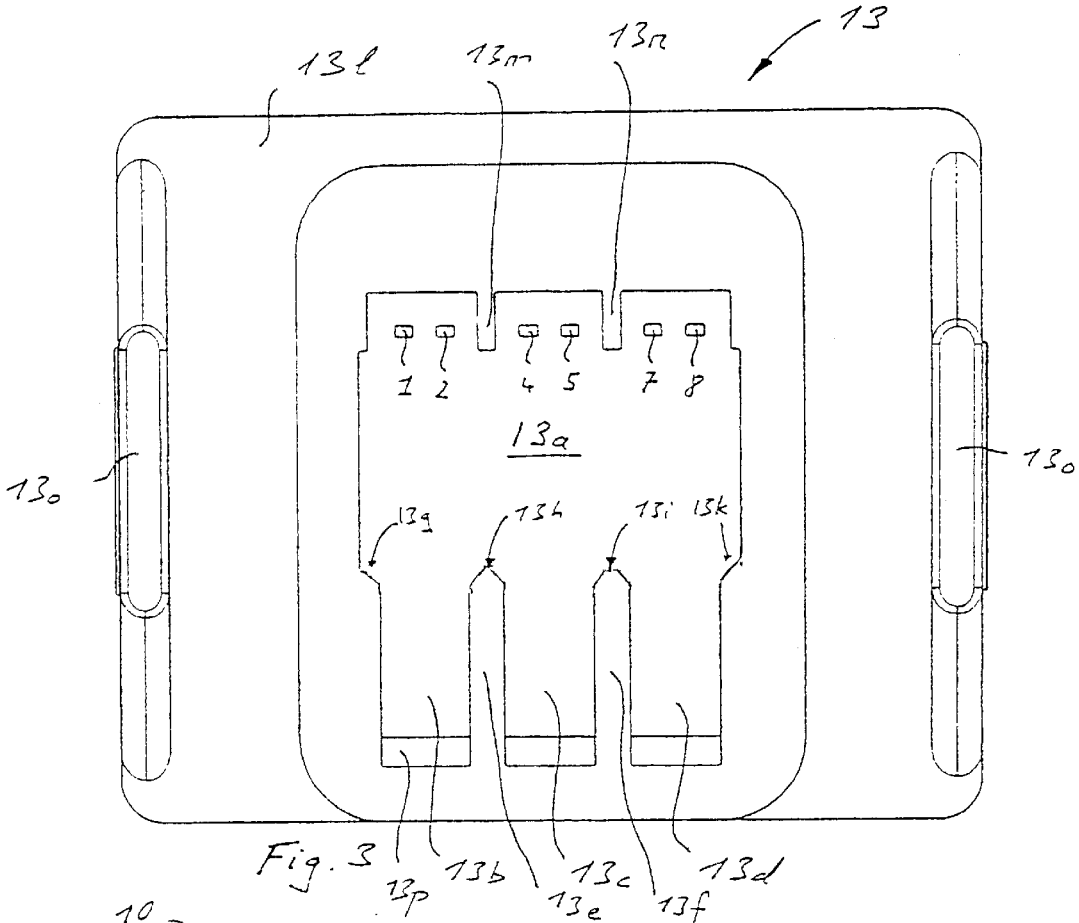
FIG. 3 is a front view of a first embodiment of an adapter.
Figure 4:
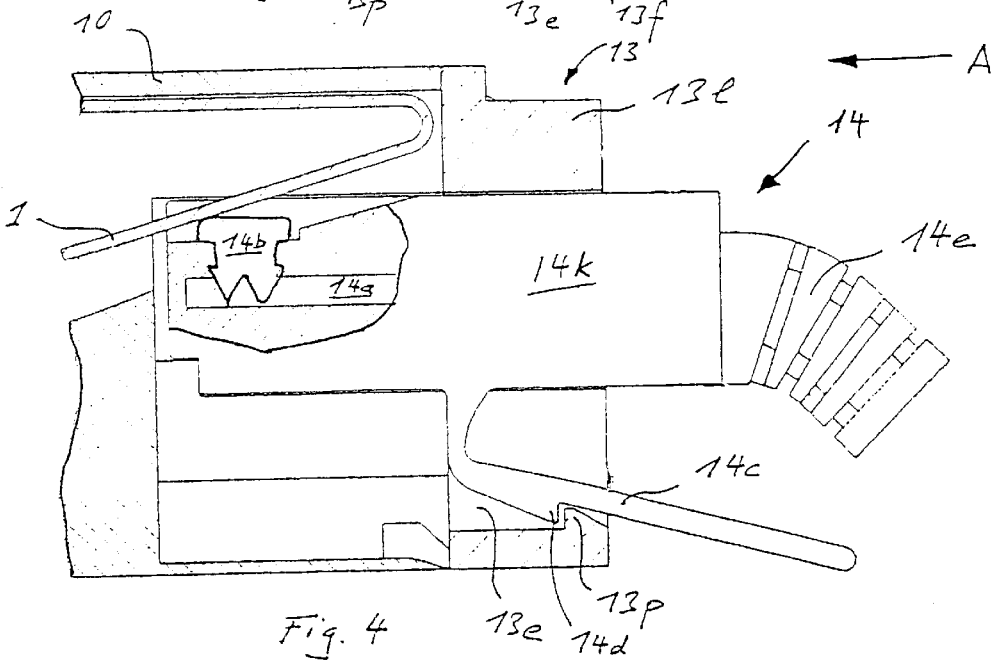
FIG. 4 is a side view of the first adapter with socket and plug in a sectional representation.

FIG. 3 is a front view of a first embodiment of an adapter 13 with housing 13*l* and opening 13*a* from the viewing direction A (FIG. 4). The adapter 13 may be held at the handles 13*o* and firmly connected in a removable manner or permanently to the socket 10, for example via the securing means 13*q*, which are configured as lock-in parts. The adapter 13 is secured to the front side of the socket 10 such that the opening 13*a* comes to lie in front of the opening 10*e* in the socket 10. The opening 13*a* is bounded by a plurality of guide means 13*e*–13*k*, 13*m*, 13*n*, which guide means form three plug openings 13*b*, 13*c*, 13*d* to accommodate a plug 14. These plug openings 13*b*, 13*c*, 13*d* are arranged opposite the socket contacts 1, 2, 4, 5, 7, 8 such that the plug contacts 14*b* of the plugs 14 which are to be introduced are accurately guided in relation to the socket contacts 1, 2, 4, 5, 7, 8, so that electrical contact is established between these when the plug 14 is introduced.

The sectional representation according to FIG. 4 shows the socket 10 with socket contact 1, the adapter 13 (FIG. 3), which is arranged in front of the opening 10*e* (FIG. 2*b*) in the socket 10 and in which the plug 14 is introduced. The adapter 13 as well as the plug 14 are configured in relation to the standardised socket 10, and the plug 14 is held by the adapter 13 in relation to the socket 10 such that the plug contacts 14*b* lie, for example, against the socket contact 1 and thus establish an electrically conductive connection. The plug contact 14*b* is connected to an electrical wire conductor 14*a*, which extends through the plug housing 14*k* and the cable guide 14*e*. The plug 14 also comprises a latch means, in particular a retention element 14*c* with a lock-in element 14*d*, which lies against the lock-in projection 13*p* of the adapter 13, so that the plug 14 is held securely and yet in a removable manner in the adapter 13 or interior space 13*b*, 13*c* or 13*d* of the adapter 13.

Figure 5:
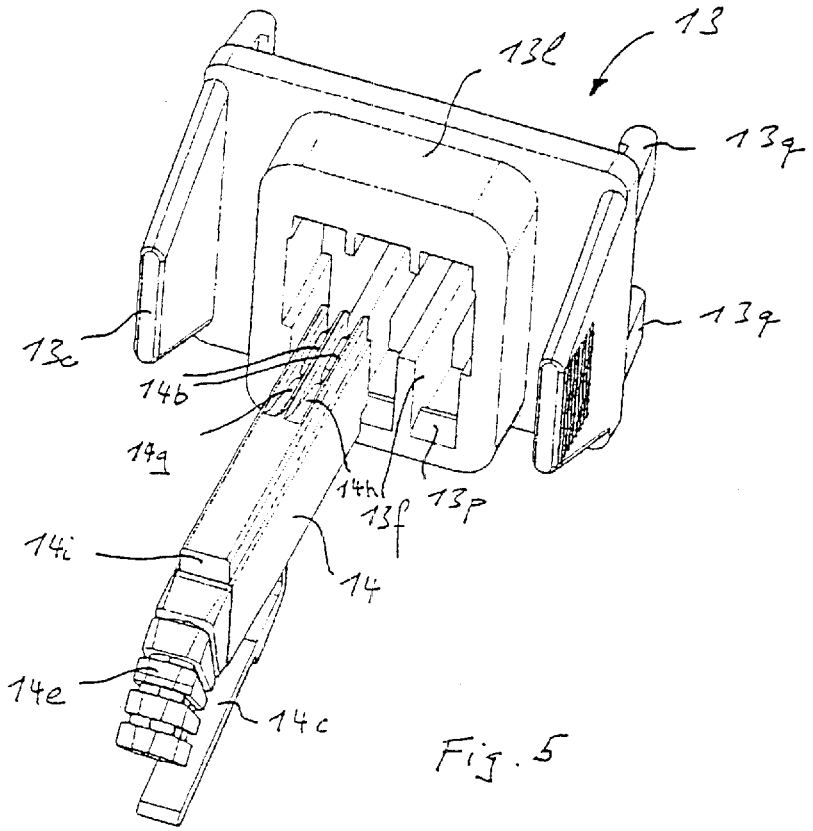
FIG. 5 is a perspective view of the first adapter with plug.

The perspective view according to FIG. 5 shows the plug 14 just before being introduced into the adapter 13. The plug 14 with guide part 14*i* comprises in the region of the front end two grooves 14*g*, 14*h*, in which a respective contact 14*b* is arranged. In the front view according to FIG. 3 the plug 14 is introduced into the plug opening 13*c*, being guided reliably and accurately at least by the guide parts 13*e*, 13*f*, 13*m*, 13*n*, 13*h* and 13*i*, so that the two plug contacts 14*b* come into contact with a respective socket contact 4, 5. The socket contacts and plug contacts 14*b* have the spacing standardised for a RJ45 plug. The socket contacts 3 and 6 are not visible in FIG. 3, as they are concealed by the guide parts 13*m*, 13*n*. The adapter 13 which is represented therefore prevents contact with the socket contacts 3 and 6.

Figure 6A:
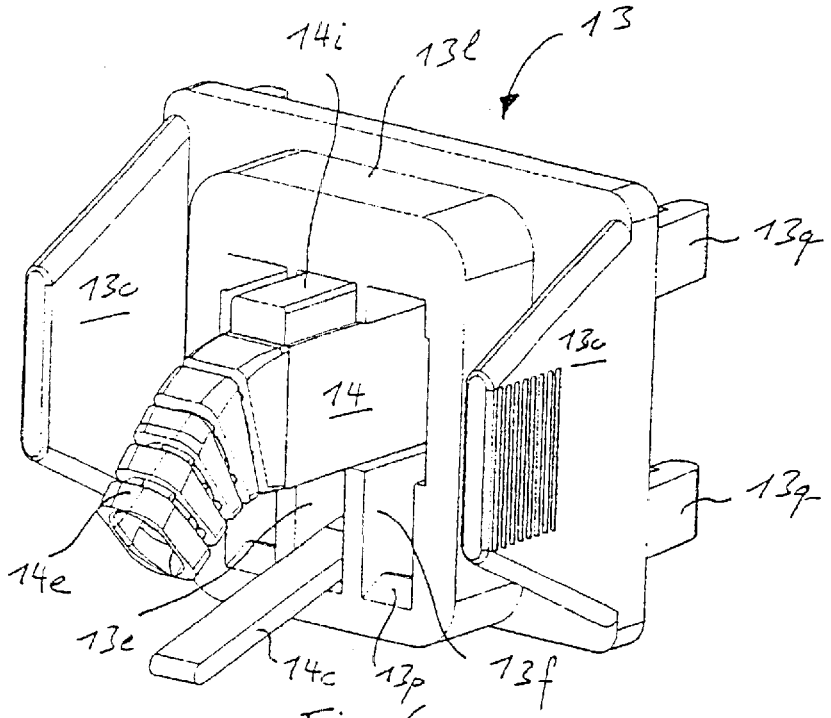
FIG. 6*a* is a perspective front view of the first adapter with plug.
Figure 6B:
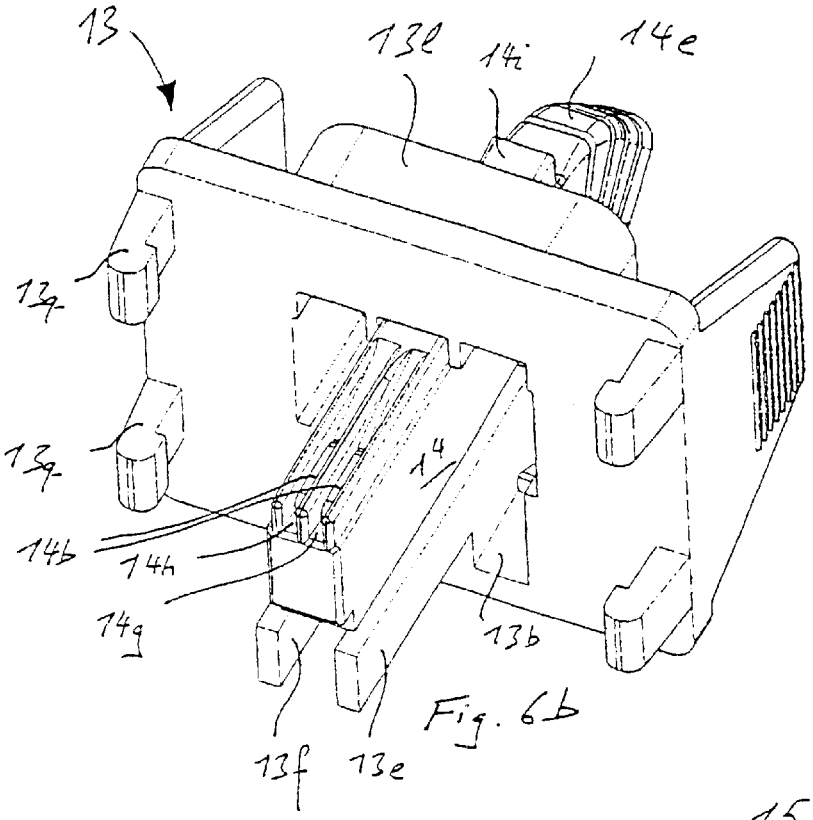
FIG. 6*b* is a perspective front view of the first adapter with plug from the rear.

FIG. 6*a* shows the plug 14 completely introduced into the adapter 13 from the viewing angle towards the socket 10. FIG. 6*b* shows the representation according to FIG. 6*a* from the opposite side (rear view), in which the sub-portion of the plug 14 projecting in relation to the adapter 13 is usually located in the interior space 10*a* of the socket 10. The guide parts 13*e*, 13*f* extend in the direction of movement of the plug 14, so that the latter lies essentially over its entire length on the guide parts 13*e*, 13*f*, which prevents the plug 14 from tilting away from the contacts 1 to 8 of the socket in the vertical direction.

The adapter 13 with correspondingly adapted plug 14 which is represented in FIGS. 3 to 6*b* enables a maximum of three plugs 14, which lie side by side and can be separately plugged in, to be introduced into a standardised socket 10.

It may prove to be disadvantageous if the socket contacts 3 and 6 cannot be contacted.

Figure 7:
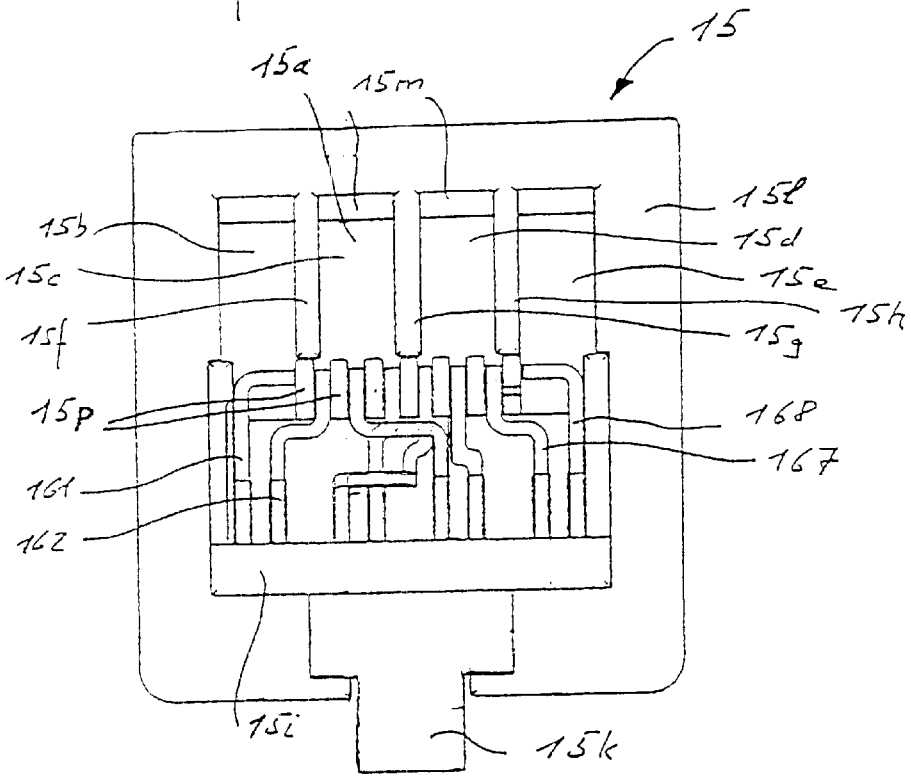
FIG. 7 is a front view of a second embodiment of an adapter.

FIG. 7 is a front view from the viewing direction B (FIG. 9) of a second embodiment of an adapter 15, in which all eight socket contacts 1–8 can be contacted. The adapter 15 comprises an adapter housing 15*l* with an opening 15*a*, which is bounded by guide means 15*f*, 15*g*, 15*h*, 15*i* forming four plug openings 15*b*–15*e*. The plug openings 15*b*–15*e* are bounded at the top by a lock-in element 15*m*. The adapter 15 also comprises eight adapter contacts 161–168 (FIG. 8), which are spaced apart by distance elements 15*p* and maintained electrically isolated from one another. The adapter 15 comprises at the bottom a latch means, in particular a retention element 15*k*, by means of which the adapter 15 can be fastened firmly, yet also in a removable manner in the lock-in element 10*b* of the of the socket 10. In this embodiment all plug connectors must be introduced with the latch upwards.

Figure 8:
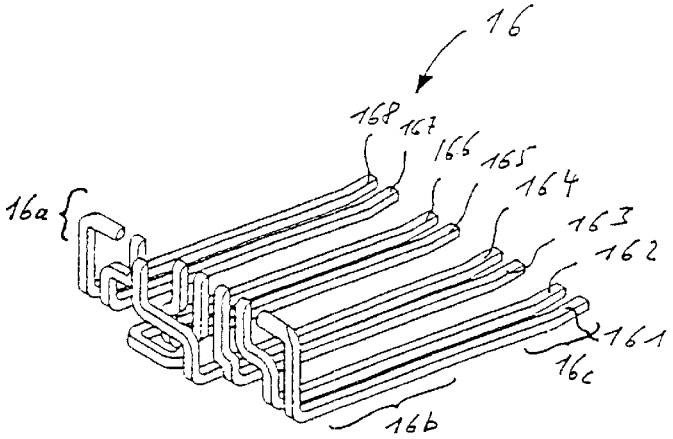
FIG. 8 is a view of the run of the contacts of the adapter according to FIG. 7.
Figure 9:
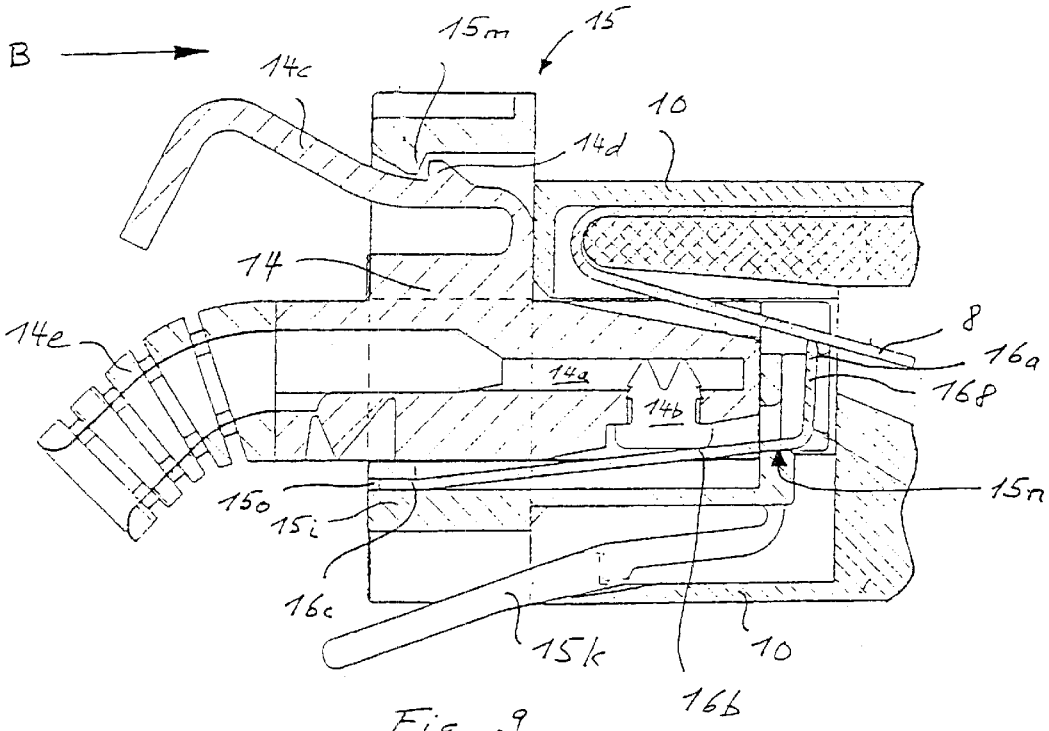
FIG. 9 is a side view of the second adapter with socket and plug in a sectional representation.

FIG. 8 is a perspective view showing the run of the adapter contacts 16 or 161–168. In a first end portion 16*a* the adapter contacts 161–168 end relatively near one another, the spacing between them being such that each adapter contact 161–168 lies against a socket contact 1–8 (FIG. 9). The adapter contacts 161–168 extend over a contact portion 16*b* to a second end portion 16*c*.

The side view represented in FIG. 9 is a longitudinal section through the socket 10, the adapter 15 as well as the plug 15. The adapter 15 is connected firmly and in a removable manner via the latch means, in particular retention element 15*k*, which is engaged with the lock-in element 10*b*. The adapter contacts 16 form a component part of the adapter 15, only the run of the adapter contact 168 being evident in the represented view. The adapter contact 168 is held at the second end portion 16*c* in a guide opening 15*o* in the base part 15*i*. The adapter contact 168 then extends freely along the contact portion 16*b*, and is only supported again at the support 15*n*, after which the adapter contact 168 leads into the end portion 16*a*. The adapter contact 168 is spring mounted along the contact portion 16*b*, within which the plug contact 14*b* of the plug 14 fits. The adapter contact 168 is in electrically conductive contact with the socket contact 8 at the end portion 16*a*. The plug 14 is held firmly but also in a removable manner in the adapter 15 or firmly but in a removable manner in relation to the socket 10 via the latch means, in particular the lock-in elements 14*d*, 15*m*, and, as can be seen from FIG. 7, also guided laterally. As is evident from FIG. 9, the purpose of the adapter contacts 161–168 is to guarantee an electrical connection between the socket contacts 1–8 and the plug contacts 14*b* of the respective plug 14. The use of adapter contacts 161–168 has the advantage of this connection enabling the position of the socket contacts 1–8 and the position of the plug contacts 14*b* to be independent of one another. In a preferred embodiment the adapter contacts 161–168 extend in a spread fashion with respect to the socket contacts 1–8 at least in the contact portion 16*b* such that the adapter contacts 161–168 are distributed over the entire width 10*c* of the interior space 10*a* of the socket 10 (FIG. 2*b*). The spacing between the contact pairs of the adapter contacts 161–168 is therefore greater than in the case of the socket contacts 1–8. The adapter contacts 161–168 could be configured without any crossover. In a preferred embodiment, as represented in FIGS. 7 and 8, the adapter contacts 161–168 exhibit crossovers. The adapter contacts 161 and 162 thus correspond to the socket contacts 1 and 2, the adapter contacts 163 and 164 to the socket contacts 3 and 6, the adapter contacts 165 and 166 to the socket contacts 4 and 5, and the adapter contacts 167 and 168 to the socket contacts 7 and 8. This arrangement has the advantage of the pairs of socket contacts 1,2; 3,6; 4,5; 7,8 in each case lying against the adapter contacts 161–168 side by side, so that the pairs can in each case be individually picked up via a separate plug 14 and routed to a conducting wire 14*a*.

Figure 10:
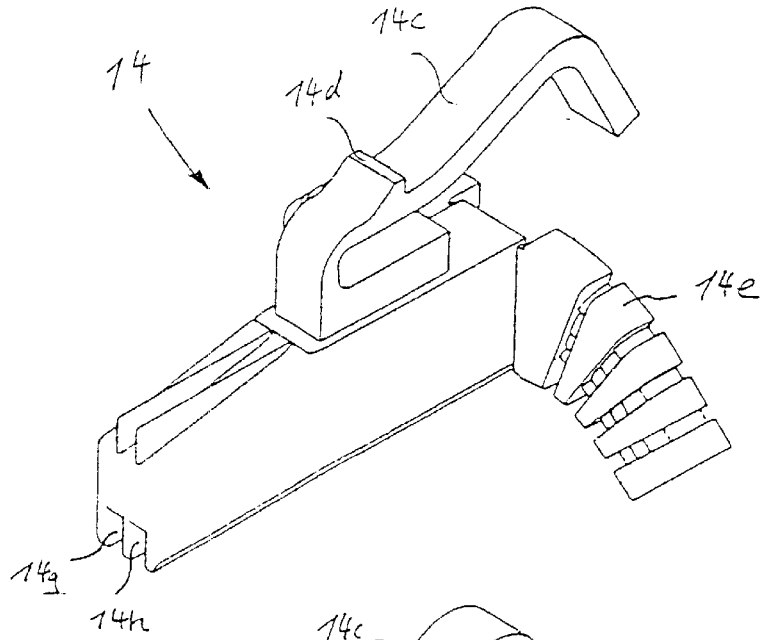
FIG. 10 is a 2-pole plug with two contacts.
Figure 11:
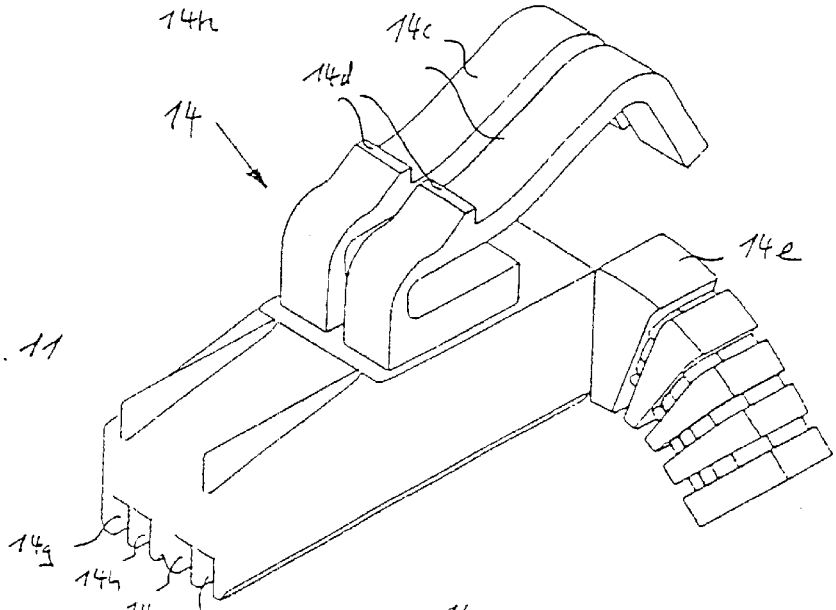
FIG. 11 is a 4-pole plug with four contacts.
Figure 12:
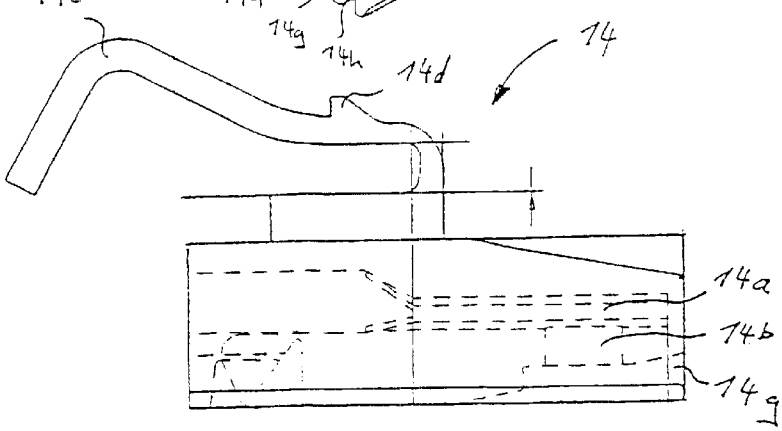
FIG. 12 is a side view of a plug according to FIG. 10 or FIG. 11.

FIG. 10 shows a plug 14 with two grooves 14*g*, 14*h* or two plug contacts 14*b* arranged therein (not shown). FIG. 11 shows a further embodiment of a plug 14 with four grooves 14*g*, 14*h* and a corresponding total of four plug contacts 14*b* (FIG. 9) arranged therein. It would also be possible to form plugs 14 with six or eight grooves or plug contacts 14*b*. FIG. 12 is a side view of the plugs 14 according to FIGS. 10 and 11, with plug contact 14*b*, conducting wire 14*a* and groove 14*g*.

Figure 13A:
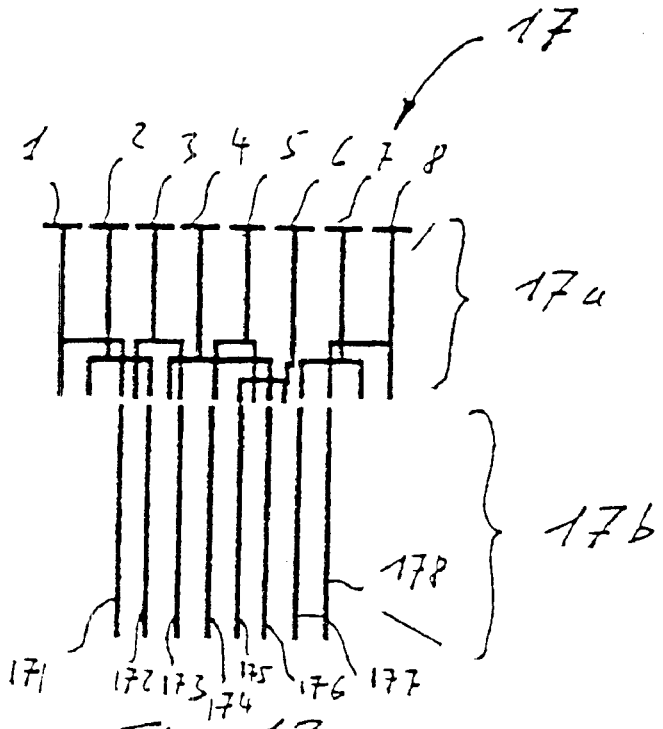
FIG. 13*a* is a diagrammatic representation of the standardised contact arrangement.

FIG. 13*a* shows in diagrammatic form a further embodiment of a socket 10, only the socket contacts 1–8 being represented here. The socket contacts 1–8 are arranged so as to be fixed in a first portion 17*a* and mobile in the transverse direction 17*c* in a second portion 17*b*, the mobile portions being indicated at 171–178. FIG. 13*a* shows the portions 171–178 in the portion 17*b* in the normal position conforming to standards, with their mutual spacing being 0.04 inches, as prescribed by the standard. An RJ45 plug can therefore be introduced into the socket 10, with contact being established between the plug contacts 9*a* of the 8-pole plug 9 and the portions 171–178. A specially configured plug 14 may also be introduced into the socket instead of the 8-pole plug 9. This plug 14 comprises a projecting lug, which is configured such that a pair of the portions 171–178 is in each case displaced by the lug in the transverse direction 17*c*. The socket contacts 1–8 or 171–178 are arranged in relation to one another at the transition point between the portion 17*a* and the portion 17*b* such that there is constant contact both before and after displacement in the transverse direction 17*c*.

Figure 13B:
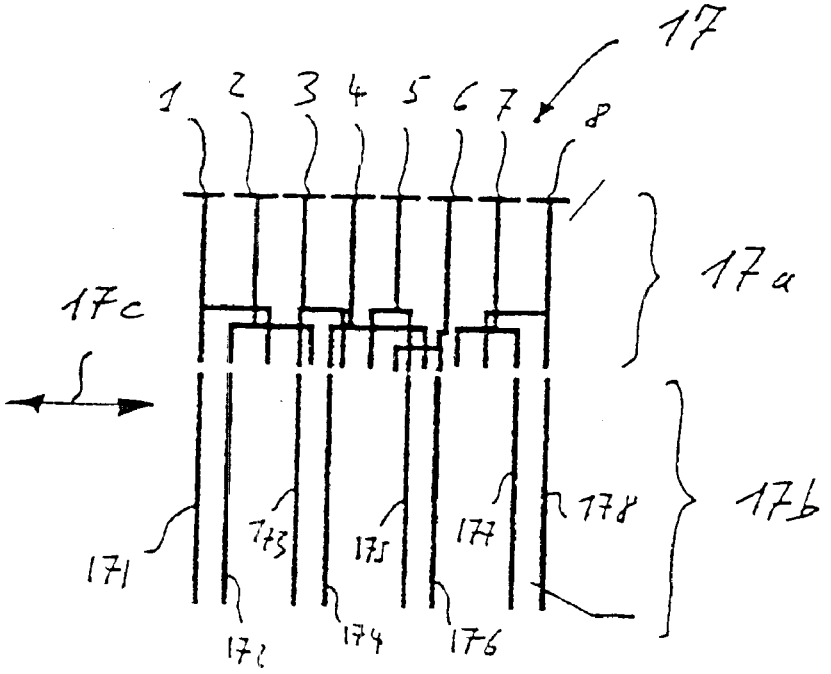
FIG. 13*b* is a diagrammatic representation of the contact arrangement for multiple use.

The arrangement represented in FIGS. 13*a* and 13*b* has the advantage of permitting the use of 8-pole plugs 9 conforming to standards and correspondingly adapted individual plugs 14 in a socket 10 thus configured, without using the adapter.

I claim:

1. An adapter for a standardized socket, in particular for a RJ45 or RJ11 socket, the adapter comprising a housing with a same opening having guide means disposed at spaced intervals around a periphery of the same opening, wherein the same opening further comprises a plurality of opening portions openly connected to each other between ones of said guide means such that at least two plugs arranged side by side can be introduced into corresponding ones of said plurality of opening portions of the same opening, and wherein the guide means are configured and oriented such that each plug which is introduced has an electrically conductive connection by way of its contacts with contacts of the socket.

2. An adapter according to claim 1, comprising a securing means for securing the adapter in front of an opening in the socket.

3. An adapter according to claim 1, comprising a lock-in element for firmly connecting a plug to the adapter in a removable manner.

4. An adapter according to claim 1, being configured for a RJ45 socket with socket contacts, wherein said same opening comprises three plug openings, which are arranged side by side, for accommodating multipole plugs, and wherein said plug openings are arranged and spaced apart such that the plug contacts, of which there are two in each case, of the introduced plugs lie against the socket contacts.

5. An adapter according to claim 4, wherein the same opening is bounded by two guide parts which are arranged so as to be in alignment in relation to the position of the socket contacts.

6. An adapter according to claim 1, wherein a plurality of adapter contacts form part of the adapter, said adapter contacts having a mutual spacing at a first end portion which corresponds to that of the socket contacts so as to establish an electrically conductive connection with the socket contacts, and said adapter contacts also comprising a contact portion having, at least in part, a mutual spacing greater than the mutual spacing at said first end portion.

7. An adapter according to claim 6, wherein the adapter contacts are arranged to extend in the adapter, and the guide means are configured and oriented in an adapted manner such that, when the plug is introduced, its plug contacts lie against adapter contacts in the contact portion.

8. An adapter according to claim 6, wherein at least two of said plurality of adapter contacts exhibit crossover.

9. An adapter according to claim 8, wherein said adapter contacts are arranged so as to extend in crossover fashion such that corresponding pairs of adapter contacts are electrically connected to corresponding ones of said socket contacts.

10. An adapter according to claim 8, wherein said adapter contacts at a second end portion are mounted in a guide opening in the adapter.

11. An adapter according to claim 8, wherein said adapter contacts are arranged so as to extend opposite the socket contacts in the interior space of the socket.

12. In combination:

an adapter for a standardized socket, in particular for a RJ45 or RJ11 socket, the adapter comprising a housing with a same opening having guide means disposed at spaced intervals around a periphery of the same opening, wherein the same opening further comprises a plurality of opening portions openly connected to each other between ones of said guide means such that at least two plugs arranged side by side can be introduced into corresponding ones of said plurality of opening portions of the same opening, and wherein the guide means are configured and oriented such that each plug which is introduced has an electrically conductive connection by way of its contacts with contacts of the socket; and a plug for the adapter, the plug having two, four or six plug contacts arranged in the plug, wherein each plug contact is connected to an electrical wire conductor.

13. A combination according to claim 12, wherein the plug contacts have a mutual spacing which corresponds to the spacing of the socket contacts of a socket.

14. A combination according to claim 12, wherein the adaptor has a lock-in element and the plug has a lock-in element which is adapted to co-operate with the lock-in element of the adapter such that the plug can be held firmly in the adapter in a removable manner.

15. A plug for an adapter for a standardized socket, in particular for a RJ45 or RJ11 socket, the adapter comprising a housing with a same opening having guide means disposed at spaced intervals around a periphery of the same opening, wherein the same opening further comprises a plurality of opening portions openly connected to each other between ones of said guide means such that at least two plugs arranged side by side can be introduced into corresponding ones of said plurality of opening portions of the same opening, and wherein the guide means are configured and oriented such that each plug which is introduced has an electrically conductive connection by way of its contacts with contacts of the socket; and wherein the plug has two, four or six plug contacts arranged in the plug, wherein each plug contact is connected to an electrical wire conductor.

* * * * *